US006852633B2

(12) United States Patent
Chen et al.

(10) Patent No.: US 6,852,633 B2
(45) Date of Patent: Feb. 8, 2005

(54) METHOD FOR OPERATING CHEMICAL MECHANICAL POLISHING ("CMP") TOOL FOR THE MANUFACTURE OF SEMICONDUCTOR DEVICES

(75) Inventors: Chien Hua Chen, Shanghai (CN); Yuan Hsin Peng, Shanghai (CN); Xiao Hua Li, Shanghai (CN)

(73) Assignee: Semiconductor Manufacturing International (Shanghai) Corporation, Shanghai (CN)

( * ) Notice: Subject to any disclaimer, the term of this patent is extended or adjusted under 35 U.S.C. 154(b) by 0 days.

(21) Appl. No.: 10/796,700

(22) Filed: Mar. 8, 2004

(65) Prior Publication Data

US 2004/0171266 A1 Sep. 2, 2004

(51) Int. Cl.[7] ..... H01L 21/302

(52) U.S. Cl. ..... 438/692; 438/690; 438/691; 438/959; 451/35; 451/36

(58) Field of Search ..... 438/692, 690, 438/691, 959; 451/35, 36, 37, 60, 65

(56) References Cited

U.S. PATENT DOCUMENTS 6,309,279 B1 * 10/2001 Bowman et al. ..... 451/41
6,506,306 B1 * 1/2003 Hammer et al. ..... 210/652
2004/0108277 A1 * 6/2004 Krulik ..... 210/723

* cited by examiner

*Primary Examiner*—Caridad Everhart
(74) *Attorney, Agent, or Firm*—Townsend and Townsend and Crew LLP

(57) ABSTRACT

A method for processing integrated circuit devices including a water recycling process. The method includes operating a chemical mechanical planarization process, which includes a discharge for process water. The process water is used to process one or more semiconductor wafers. The method also selectively discharges process water from the discharge. A step of transferring the process water from the chemical mechanical planarization process to a facility process is included. The method then uses the discharged water in the facility process.

21 Claims, 4 Drawing Sheets

Dslurry: Slurry-contained drain piping

300
PLATEN 1
PLATEN2
PLATEN3
HCLU&Qtank
201
203
205
207
305
Processing & Wet idle
DCMP-Clean
N.O.
307
303
Processing & Wet idle
DCMP-Clean
N.C.
309
301
Wet idle
DCMP-Clean
N.C.
311
Processing
Dslurry
N.O.
313
209
Pneumatic valve. N.C. : Normal Close. N.O : Normal Open
DCMP-Clean: CMP clean water drain piping
Dslurry: Slurry-contained drain piping

METHOD FOR OPERATING CHEMICAL MECHANICAL POLISHING ("CMP") TOOL FOR THE MANUFACTURE OF SEMICONDUCTOR DEVICES

BACKGROUND OF THE INVENTION

The present invention is directed integrated circuits and their processing for the manufacture of semiconductor devices. More particularly, the invention provides a method and system for operating a chemical mechanical polishing process where discharge water is recycled for use in a wafer fabrication facility process such as a local scrubber, cooling tower. But it would be recognized that the invention has a much broader range of applicability. For example, the invention can be applied to a variety of other applications that consume ultra-pure water and outputs usable facility water.

Over the past couple of decades, integrated circuits have evolved from a handful of interconnected devices fabricated on a single chip of silicon to millions of devices. Performance and complexity are far beyond what was originally imagined. In order to achieve improvements in complexity and circuit density (i.e., the number of devices capable of being packed onto a given chip area), the size of the smallest device feature, also known as the device "geometry", has become smaller with each generation of integrated circuits. Certain semiconductor devices are now being fabricated with features less than a quarter of a micron across.

Increasing circuit density has not only improved the complexity and performance of circuits but also provided lower costs to consumers. Conventional semiconductor fabrication plants often costs hundreds of millions or even billions of U.S. dollars to construct. Each fabrication facility has a certain capacity measured in tens of thousands of wafer starts per month. Each wafer also has a certain number of potential chips. By manufacturing individual devices smaller and smaller, more devices are packed in a given area of semiconductor, which increases output of the fabrication facility. Making devices smaller is always very challenging, as each process for the manufacture of semiconductor devices has a limit. That is to say, a given process typically only works down to a certain feature size, and then either the process or the device layout should be changed.

Costs of operating fabrication facilities have also increased dramatically. As many know, many U.S. fabrication facilities that were operable in the 1970's and 1980's no longer exist. Many of such fabrication facilities migrated to Japan in the 1980's and then to Korea and Taiwan in the 1990's. As demand for lower cost fabrication facilities continues, China has now become a choice geographic location for fabrication facilities to start up. Many companies have announced plans to begin manufacturing facilities in China. Such companies include, but are not limited to, Motorola, Inc., Taiwan Semiconductor Manufacturing Corporation of Taiwan, also called TSMC, and others. Although labor costs may be somewhat lower in China, there are still many costs that still need to be reduced or even eliminated as the demand for lower cost silicon continues!

From the above, it is seen that an improved technique for processing semiconductor devices is desired.

BRIEF SUMMARY OF THE INVENTION

The present invention is directed integrated circuits and their processing for the manufacture of semiconductor devices. More particularly, the invention provides a method and system for operating a chemical mechanical polishing process where discharge water is recycled for use in a facility process such as a local scrubber, cooling tower. But it would be recognized that the invention has a much broader range of applicability. For example, the invention can be applied to a variety of other applications that consume ultra-pure water and outputs usable facility water.

In a specific embodiment, the invention provides a method for processing integrated circuit devices including a water recycling process. The method includes operating a chemical mechanical planarization process, which includes a discharge for process water. The process water is used to process one or more semiconductor wafers. The method also selectively discharges process water from the discharge. A step of transferring the process water from the chemical mechanical planarization process to a facility process is included. The method then uses the discharged water in the facility process.

In an alternative specific embodiment, the invention provides a method for processing integrated circuit devices including a water recycling process. The method includes operating a chemical mechanical polishing process using an incoming stream of ultra-pure water. The chemical mechanical polishing process includes a discharge for used ultra-pure water, which has been used to process one or more semiconductor wafers and discharged through the discharge to form facility water. The method selectively discharges the facility water from the discharge of the chemical mechanical polishing process and transfers the facility water from the discharge of the chemical mechanical polishing process to a facility process. The transferring is free from any chemical treatment of the discharged process water. Next, the method uses the discharged water in the facility process.

In yet an alternative specific embodiment, the invention provides a system for chemical mechanical polishing. The system has a plurality of processing stations. Each of the processing stations is configured to perform at least one processing operation. A discharge line is coupled to one or more of the processing stations to receive discharge water. A valve is coupled to the discharge line to selectively output the discharge water for use in a facility process. A drain line is coupled to the discharge line for outputting the discharge water to a drain.

Many benefits are achieved by way of the present invention over conventional techniques. For example, the present technique provides an easy to use process that relies upon conventional technology. In some embodiments, the method provides higher device yields in dies per wafer. Additionally, the method provides a process that is compatible with conventional process technology without substantial modifications to conventional equipment and processes. Preferably, the invention can be applied to a variety of applications such as memory, ASIC, microprocessor, and other devices. Depending upon the embodiment, one or more of these benefits may be achieved. These and other benefits will be described in more throughout the present specification and more particularly below.

Various additional objects, features and advantages of the present invention can be more fully appreciated with reference to the detailed description and accompanying drawings that follow.

DETAILED DESCRIPTION OF THE INVENTION

The present invention is directed integrated circuits and their processing for the manufacture of semiconductor devices. More particularly, the invention provides a method and system for operating a chemical mechanical polishing process where discharge water is recycled for use in a facility process such as a local scrubber, cooling tower. But it would be recognized that the invention has a much broader range of applicability. For example, the invention can be applied to a variety of other applications that consume ultra-pure water and outputs usable facility water.

Figure 1:
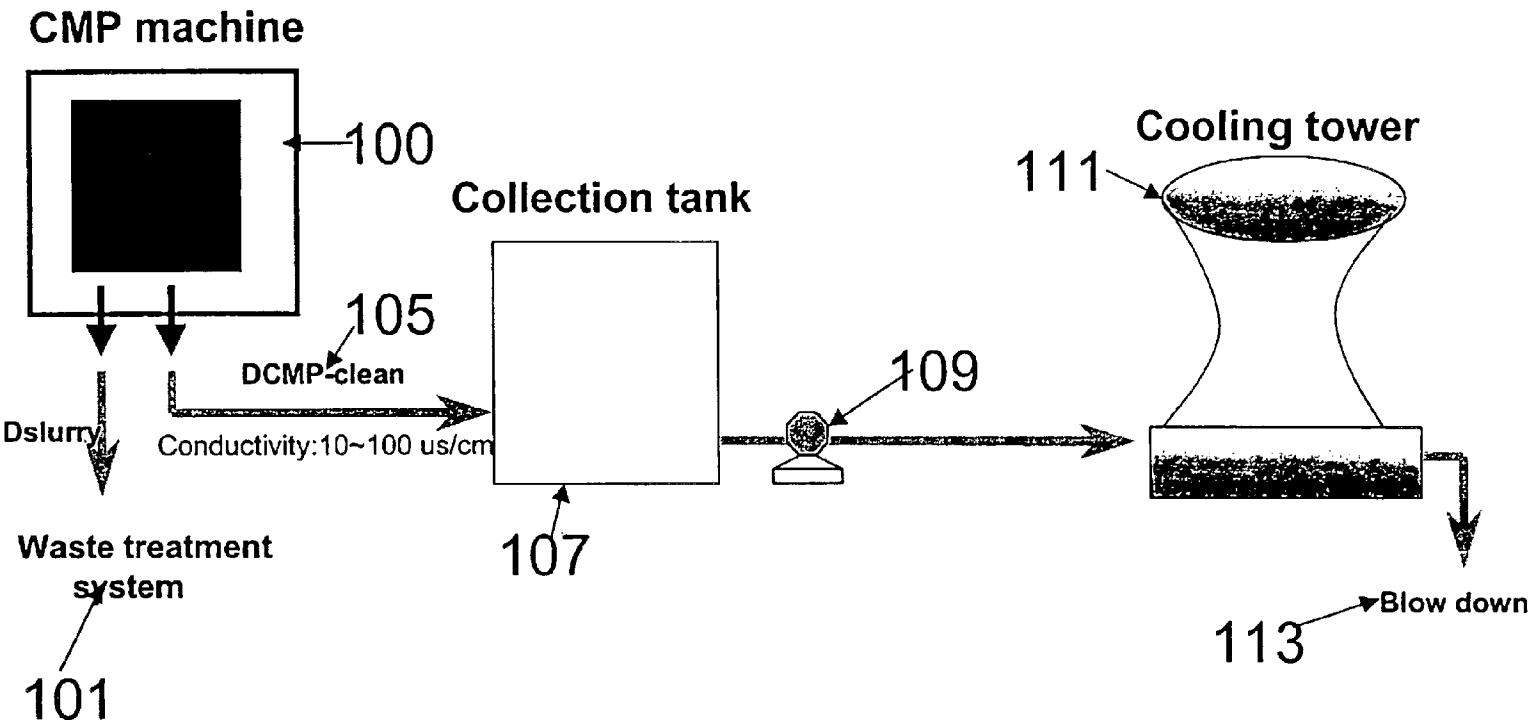
FIG. 1 is a simplified diagram of water recycling method according to an embodiment of the present invention.

FIG. 1 is a simplified diagram 100 of a water recycling method according to an embodiment of the present invention. This diagram is merely an example, which should not unduly limit the scope of the claims herein. One of ordinary skill in the art would recognize many other variations, modifications, and alternatives. As shown, the method begins at start, step 100. The method operates a chemical mechanical planarization process. Such process includes a discharge, which is coupled to the process, for process water, which is ultra-pure. An example of such ultra-pure water is provided in the Table below.

TABLE 1

Ultra-Pure Water

| Specification (UF Outlet) | Unit | Control Spec. |
|---|---|---|
| Flowrate | $M^3$/hour | |
| Resistivity | Mohm-cm | >18 |
| Particle | pcs/ml | <3/0.1 um |
| DO | ppb | <3 |
| TOC | ppb | <3 |
| Bacteria | cfu/L | <5 |
| $SiO_2$ | ppb | <2 |
| Al | ppb | |
| As | ppb | |
| B | ppb | |
| Ca | ppb | <0.05 |
| Cr | ppb | |
| Cu | ppb | |
| Au | ppb | |
| Fe | ppb | <0.05 |
| Pb | ppb | |
| Li | ppb | |
| Mg | ppb | |
| Mn | ppb | |
| Ni | ppb | |
| K | ppb | <0.05 |
| Na | ppb | <0.05 |
| Zn | ppb | <0.05 |
| F | ppb | |
| Cl | ppb | <0.05 |
| $NO_3$ | ppb | |
| $PO_4$ | ppb | |
| $SO_4$ | ppb | |
| $NH_4$ | ppb | |

The process water is used to process one or more semiconductor wafers. Preferably, the process selectively discharges 105 used process water from the discharge of the planarization process to a facility process. Such discharge can be a waste treatment plant. The facility process uses the discharged water in the facility process. Alternatively, the process selectively discharges the used process water, which has contaminants, into a drain region for waste treatment 101. Such drain region is to a water treatment facility or may be used for recycling. Alternatively, the recycled water is transferred form the planarization process through a line to a collection tank 107, which is coupled to a pump 109. The collection tank is connected through a line to the facility process, such as a cooling tower 111. Preferably, the line from the planarization process to the cooling tower is substantially free from any chemical treatment or the like. The cooling tower includes a drain for blow down 1113. Further details of the present method are provided throughout the present specification and more particularly below.

A method according to an embodiment of the present invention may be provided as follows:

1. Introduce ultra-pure water into platen tool and rinse station for semiconductor waters in a chemical mechanical polishing tool;
2. Process wafers using ultra-pure water in platen tool and rinse station;
3. Transfer used water from rinse station to a line coupled to the rinse station for a facility process;
4. Transfer used water including slurry and/or chemicals during operation of the platen tool to a drain line coupled to the platen tool;
5. Maintain open valve coupled to drain line and close valve coupled to facility line coupled to platen tool;
6. Finish processing of wafers using platen tool;
7. Stop flow of chemical species and/or slurry into platen tool and rinse wafers;
8. Close valve for drain line coupled to platen tool and open valve for facility line coupled to platen tool;
9. Transfer water from platen tool, which has not been used, to the facility line for use in the facility process;
10. Store water in storage tank;
11. Transfer water to from storage tank facility process via line for use of water; and
12. Perform other steps, as desired.

The above sequence of steps provides a method for operating a chemical mechanical polishing tool according to an embodiment of the present invention. The method selectively opens and closes certain valves at selected process times to rinse the platen tool after use and transfer water from the process to use at a facility process. Preferably, the transfer of the water from the chemical mechanical polishing process to the facility process occurs without any chemical treatment of the water, which is cost effective and efficient.

Figure 2:
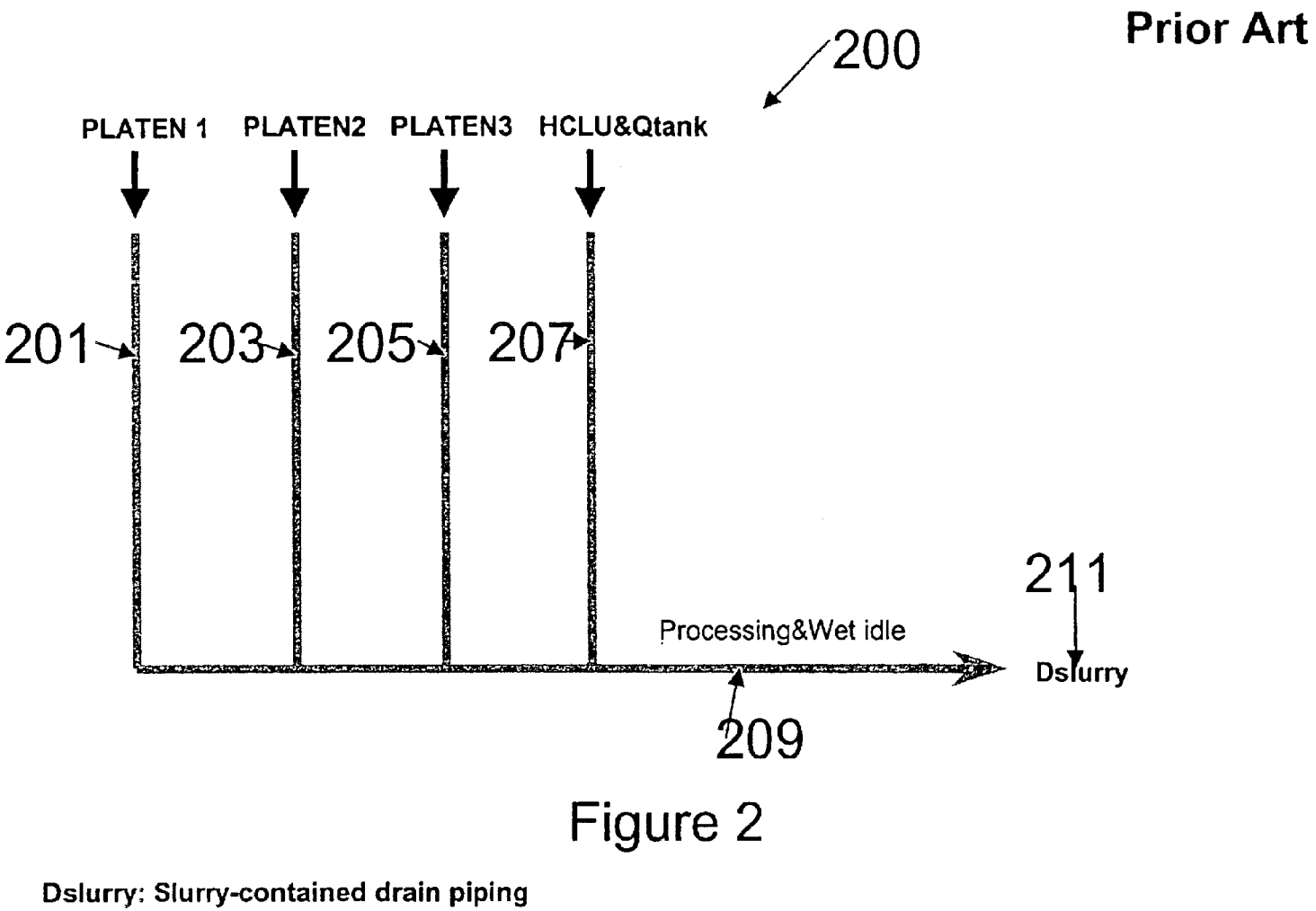
FIG. 2 is a simplified block diagram of a conventional chemical mechanical polishing tool.

FIG. 2 is a simplified block diagram of a conventional chemical mechanical polishing tool 200 drain configuration. This diagram is merely an example, which should not unduly limit the scope of the claims herein. One of ordinary skill in the art would recognize many other variations, modifications, and alternatives. As shown, conventional tool 200 drain configuration includes a plurality of lines 201, 203, 205, 207 each of which come from a respective process, such as platen 1, platen 2, platen 3, and holding tank. Each platen includes a polishing pad coupled to a slurry source and water source to process a surface or film on a semiconductor wafer. Each of these processes includes drain lines, which come together at line 209. Contaminated water including slurry are often mixed with relatively clean water and is routed through the common line. We discovered that during non-processing times, water continues to drain through the drain lines but such water is often relatively clean and may be used for processing in other facility processes.

A method according to the present invention may be outlined as follows:

1. Introduce ultra-pure water into chemical clean process for semiconductor waters in a chemical mechanical polishing tool;
2. Process wafers using ultra-pure water and selected chemical species (e.g., HF, NH4OH);
3. Transfer used water including chemicals through line coupled to the chemical clean process to drain for recycling or removal;
4. Maintain open valve coupled to line and close valve coupled to facility line;
5. Finish processing of wafers using the water and chemical species;
6. Stop flow of chemical species into process and rinse wafers including chemical clean process;
7. Close valve for line and open valve for facility line;
8. Transfer water from chemical clean process, which has not been used, through facility line;
9. Store water in storage tank;
10. Transfer water to facility process for use of water; and
11. Perform other steps, as desired.

The above sequence of steps provides a method for operating a chemical mechanical polishing tool according to an embodiment of the present invention. The method selectively opens and closes certain valves at selected process times to rinse the chemical clean process after use and transfer water from the process to use at a facility process. The transfer of the water from the chemical mechanical polishing process to the facility process occurs without any chemical treatment of the water, which is cost effective and efficient.

A method according to the present invention may be outlined as follows:

1. Introduce ultra-pure water into chemical clean process for semiconductor waters in a chemical mechanical polishing tool;
2. Process wafers using ultra-pure water and selected chemical species (e.g., HF, NH4OH);
3. Transfer used water including chemicals through line coupled to the chemical clean process to drain for recycling or removal;
4. Maintain open valve coupled to line and close valve coupled to facility line;
5. Finish processing of wafers using the water and chemical species;
6. Stop flow of chemical species into process and rinse wafers including chemical clean process;
7. Continue to maintain flow of rinse water to substantially remove chemical species and/or other contaminants from the rinsed waters;
8. Close valve for line and open valve for facility line;
9. Transfer water from chemical clean process, which has not been used, through facility line without any chemical treatment;
10. Store water in storage tank without any chemical treatment;
11. Transfer water to facility process for use of water without any chemical treatment; and
12. Perform other steps, as desired.

The above sequence of steps provides a method for operating a chemical mechanical polishing tool according to an embodiment of the present invention. The method selectively opens and closes certain valves at selected process times to rinse the chemical clean process after use and transfer water from the process to use at a facility process. The transfer of the water from the chemical mechanical polishing process to the facility process occurs without any chemical treatment of the water, which is cost effective and efficient. Details of the present method can be found throughout the present specification and more particularly below.

Figure 3:
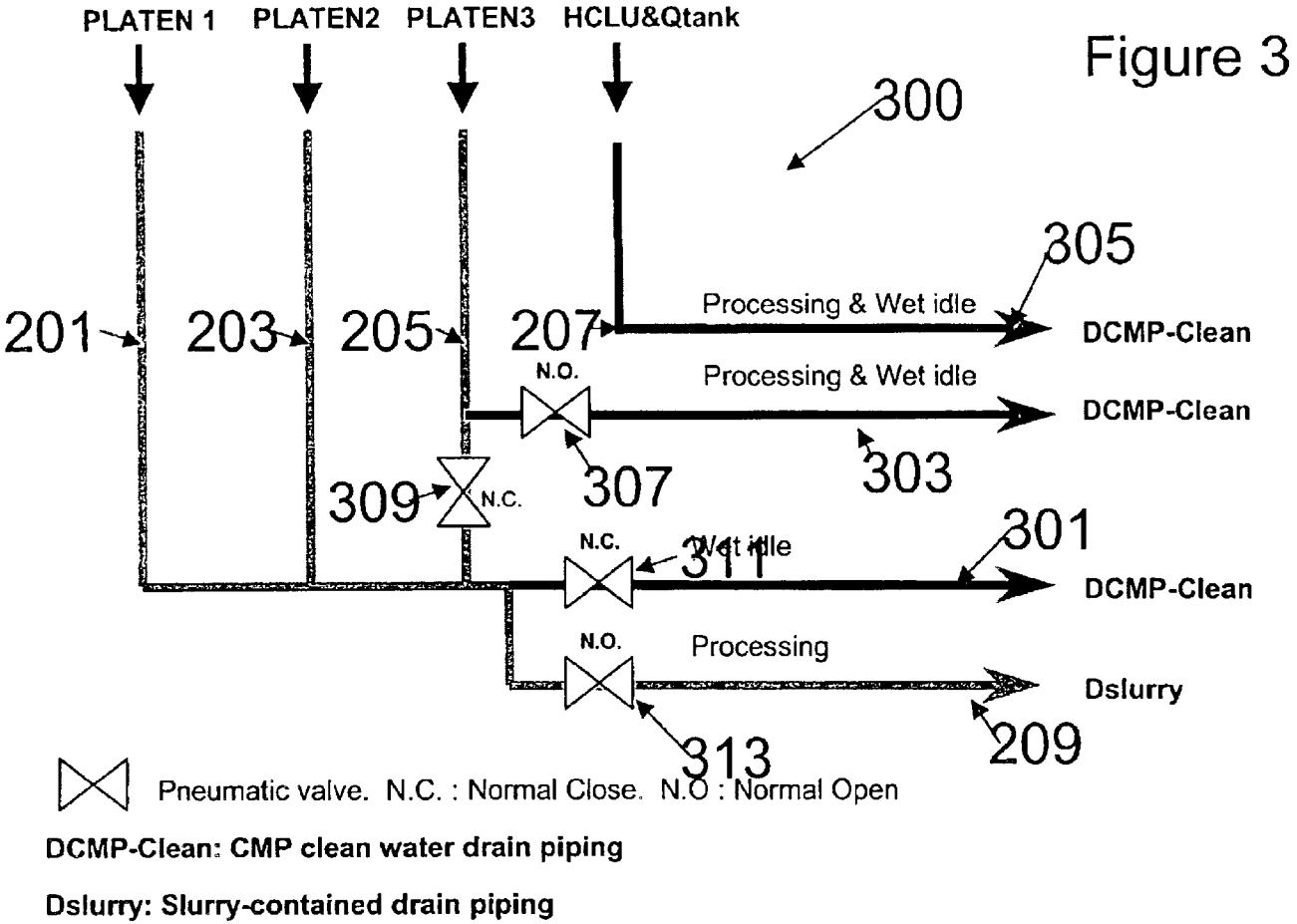
FIG. 3 is a detailed block diagram of one kind of chemical mechanical polishing tool according to an embodiment of the present invention.

FIG. 3 is a detailed block diagram 300 of a chemical mechanical polishing tool piping configuration according to an embodiment of the present invention. This diagram is merely an example, which should not unduly limit the scope of the claims herein. One of ordinary skill in the art would recognize many other variations, modifications, and alternatives. As shown, the piping configuration includes platen line 201, platen line 203, platen line 205, holding tank 207, and can include others. Holding tank 207 receives ultra-pure water from a water source. The ultra-pure water is used to rinse wafers. Even after rinsing such waters, the ultra-pure water is still fairly clean and capable of being used in facility processes. Accordingly, water exits through line 305 and returns back to a facility process.

Each of the platen includes transfer water that has been contaminated with slurry and/or chemicals and also includes transfer water that is substantially clean and capable of being used in a facility process. Each platen line is coupled to one or more valves that direct the water to either a water treatment facility for cleaning purposes or a facility process. As shown, platen line 201 is coupled to valve 311, which is normally closed and only allows water to transfer to the facility process while the tool is idle, which passes clean water for recycling. When value 311 is open, valve 313, which is normally open, is closed. Valve 313 is open while valve 311 is closed, which allows contaminated slurry water to exit to a drain for recycling. Platen 2 is also coupled to the same valves as platen 1 and operates in the same manner. Platen 3 is coupled to valve 307, which is normally open, and is also coupled to valve 309, which is normally closed. Platen 3 is substantially a clean process where the water exiting the process can be used for processing at a facility process, such as a scrubbing process, a cooling process and others.

Figure 4:
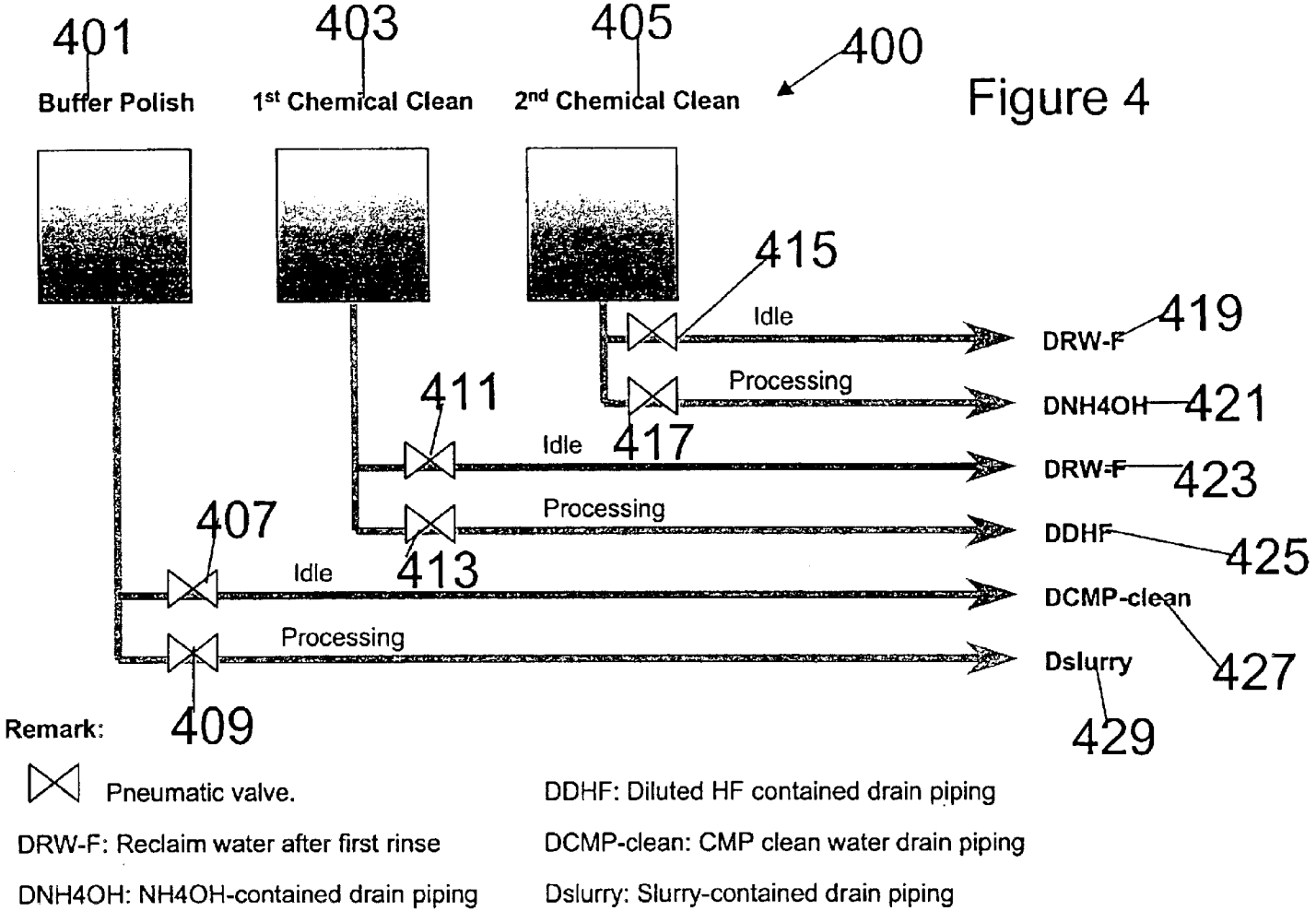
FIG. 4 is a detailed block diagram of another kind of chemical mechanical polishing tool according to an embodiment of the present invention

FIG. 4 is a detailed block diagram of a chemical mechanical polishing tool piping configuration 400 according to an alternative embodiment of the present invention. This diagram is merely an example, which should not unduly limit the scope of the claims herein. One of ordinary skill in the art would recognize many other variations, modifications, and alternatives. As shown, the piping configuration includes buffer polish 401, chemical clean 1 403, chemical clean 405, and possibly others. Buffer polish is coupled to line 427 and line 429 respectively through valve 407 and 409. When buffer polish is processing wafers, water exiting from the process is often contaminated with slurry and/or chemicals. Such water exists through line 429 for recycling or to a drain where valve 409 is open and valve 407 is closed. Alternatively, valve 407 is open and valve 409 is closed when the buffer polish is idle, where water is not processed by merely enters and exits through line 427. The water under the idle condition is substantially clean and capable of use in a facility process.

In an alternative embodiment, chemical clean 1 includes transferring lines that are operable in at least three conditions. During idle times, chemical clean transfers water from the chemical clean process to a facility process 423 only after such clean process has been rinsed. After such rinse, valve 411 is open and valve 413 is closed. Before then, water transfers to recycling via line 425 where valve 413 is open and valve 411 is closed. Clean process 403 uses an etchant such as dilute hydrofluoric acid or the like. Clean process 405 operates in the same manner as clean process 403 except clean process 405 uses a different cleaning solution, such as a ammonium hydroxide or the like. Since chemicals are used in these cleaning processes, water is provided to the facility for facility use only after such processes have been rinsed. Of course, there can be many variations, modifications, and alternatives.

It is also understood that the examples and embodiments described herein are for illustrative purposes only and that various modifications or changes in light thereof will be suggested to persons skilled in the art and are to be included within the spirit and purview of this application and scope of the appended claims.

What is claimed is:

1. A method for processing integrated circuit devices including a water recycling process, the process comprising:

operating a chemical mechanical planarization process, the chemical mechanical planarization process including a discharge for process water, the process water being used to process one or more semiconductor wafers;

selectively discharging process water from the discharge;

transferring the process water from the chemical mechanical planarization process to a facility process; and using the discharged water in the facility process;

wherein the facility process is selected from at least a cooling tower and/or a local scrubber.

2. The method of claim 1 wherein the discharge water is characterized by a pH value ranging from about 6 to about 10.

3. The method of claim 1 wherein the discharge water is characterized by a conductivity is less than about 2000 $\mu$ siemens per centimeter.

4. The method of claim 1 wherein the selectively discharging is provided using a control valve coupled to the discharge, the control valve being coupled to computer hardware.

5. The method of claim 1 wherein the discharge includes a plurality of lines, each of the lines being coupled to one or more processing stations.

6. The method of claim 1 wherein the transferring to the facility process comprises transferring to a collection tank before transferring the discharge water to the facility process.

7. The method of claim 1 wherein the selectively discharging comprises outputting a signal in response to process in computer software to open a value to release the process water.

8. The method of claim 1 wherein the process water is ultra-pure water having a resistivity of about 18 Mega-ohms.

9. The method of claim 1 wherein the transferring of the process water from the chemical mechanical planarization process to a facility process occurs free from any chemical treatment between the chemical mechanical planarization process and the facility process.

10. A method for processing integrated circuit devices including a water recycling process, the process comprising:

operating a chemical mechanical polishing process using an incoming stream of ultra-pure water, the chemical mechanical polishing process including a discharge for used ultra-pure water;

using the ultra-pure water to clean one or more semiconductor wafers while a flow of any chemical species have been stopped to the one or more semiconductor wafers, the used ultra-pure water forming a facility water;

selectively discharging the facility water from the discharge of the chemical mechanical polishing process and transferring the facility water from the discharge of the chemical mechanical polishing process to a facility process, the discharged process water being free from any chemical treatment from the discharge to the facility process; and using the discharged process water in the facility process.

11. The method of claim 10 wherein selectively discharging is provided by a valve coupled to the chemical mechanical planarization process.

12. The method of claim 10 wherein the ultra-pure water is characterized by a resistance of about 18 mega-ohm.

13. The method of claim 12 wherein the ultra-pure water is substantially free from particles greater than about 0.05 microns in dimension.

14. The method of claim 10 wherein the transferring the facility water from the discharge of the chemical mechanical polishing process to a facility process includes storing the facility water in a storage facility before use by the facility process.

15. The method of claim 14 wherein the facility process is selected from a cooling process, a scrubbing process.

16. A system for chemical mechanical polishing, the system comprising:

a plurality of processing stations, each of the processing stations being configured to perform at least one processing operation;

a discharge line coupled to one or more of the processing stations to receive discharge water;

a first valve coupled to a chemical input line to introduce chemical species to one or more of the processing stations;

a second valve coupled to an ultra-pure water line to introduce ultra-pure water to at least one or more of the processing stations;

a third valve coupled to the discharge line to selectively output the discharge water for use in a facility process while the first valve for introducing chemical species to one at least one or more of the processing stations is closed; and a drain line coupled to the discharge line for outputting the discharge water to a drain;

whereupon the discharge water is substantially used ultra-pure water free used for a rinse process associated with one or more of the processing stations.

17. The system of claim 16 further comprising a computer system coupled to the valve, the computer system including one or more memories, the one or more memories including a first code directed to actuate the value to output the discharge water for use in the facility process.

18. The system of claim 16 wherein the discharge line comprises a plurality of lines.

19. The system of claim 16 further comprising a source line for ultra-pure water coupled to one or more of the processing stations, the ultra-pure water being discharge water after being used by one or more of the processing stations.

20. A method for processing semiconductor wafers, the method comprising:

introducing ultra-pure water into a chemical clean process for semiconductor wafers in a chemical mechanical polishing tool;

processing the semiconductor wafers using the ultra-pure water and selected chemical species;

transferring the used water including the ultra-pure water and the selected chemical species to a drain for recycling or removal;

stopping flow of the chemical species;

rinsing the semiconductor wafers using the ultra-pure water;

transferring the used ultra-pure water to a facility line;

using the used ultra-pure water in a facility process.

21. The method of claim 20 wherein the facility process is selected from a cooling process or a scrubber process.

* * * * *